US007357394B2

(12) United States Patent
Halverson

(10) Patent No.: US 7,357,394 B2
(45) Date of Patent: Apr. 15, 2008

(54) MODULAR SHOOTING RANGE

(75) Inventor: Michael D. Halverson, Las Vegas, NV (US)

(73) Assignee: SRI Acquisition Corp., North Las Vegas, NV (US)

( * ) Notice: Subject to any disclaimer, the term of this patent is extended or adjusted under 35 U.S.C. 154(b) by 0 days.

(21) Appl. No.: 11/189,511

(22) Filed: Jul. 26, 2005

(65) Prior Publication Data

US 2007/0210522 A1 Sep. 13, 2007

Related U.S. Application Data

(60) Provisional application No. 60/692,402, filed on Jun. 21, 2005, provisional application No. 60/615,433, filed on Oct. 1, 2004.

(51) Int. Cl.
*F41J 1/12* (2006.01)

(52) U.S. Cl. ..... 273/410; 273/404

(58) Field of Classification Search ..... 273/404–410
See application file for complete search history.

(56) References Cited

U.S. PATENT DOCUMENTS

| | | | | |
|---|---|---|---|---|
| 3,398,959 | A | 8/1968 | Sanzare | |
| 3,820,294 | A | 6/1974 | Parker | |
| 4,088,322 | A * | 5/1978 | Nikoden, Jr. | 273/406 |
| 4,129,970 | A | 12/1978 | Whitney | |
| 4,164,901 | A * | 8/1979 | Everett | 454/228 |
| 4,201,385 | A * | 5/1980 | Szabados | 273/410 |
| 4,280,307 | A | 7/1981 | Griffin | |
| 4,320,606 | A | 3/1982 | GangaRao | |
| 4,509,301 | A | 4/1985 | Head | |
| 4,598,631 | A * | 7/1986 | Everett | 454/237 |
| 4,625,484 | A | 12/1986 | Oboler | |
| 4,653,239 | A | 3/1987 | Randa | |
| 4,677,798 | A | 7/1987 | Phillips | |

(Continued)

FOREIGN PATENT DOCUMENTS

| | | |
|---|---|---|
| GB | 2345069 | 6/2000 |

(Continued)

OTHER PUBLICATIONS

Shooting Solutions Home, information found at www.shootingsolutions.com, Shooting Solutions Home, © 2000 Shooting Solutions, Inc., 1 pg.

(Continued)

*Primary Examiner*—Mark S Graham
(74) *Attorney, Agent, or Firm*—Workman Nydegger

(57) ABSTRACT

Disclosed is a modular, expandable, and portable shooting range system. The system can include one or more shooting modules that mount together to provide different numbers of shooting lanes with various lengths. The shooting modules are pre-engineered with removable panels to permit additional shooting modules to be added on as customer orders. This configuration also permits adding to the length of the shooting range to accommodate firing of different weapons. The shooting range system can further include a control booth which is divided from the shooting lanes. The control booth can be integrally formed with the shooting modules, or can be separate. The control booth can include a module control which allows a person to control lighting, air, and target control systems of the shooting range system, and can further provide a safe location to view the range.

35 Claims, 8 Drawing Sheets

U.S. PATENT DOCUMENTS

| | | | | |
|---|---|---|---|---|
| 4,683,688 | A | | 8/1987 | Wojcinski |
| 4,731,964 | A | | 3/1988 | Phillips |
| 4,759,160 | A | | 7/1988 | Fischer |
| 5,088,741 | A | | 2/1992 | Simonetti |
| 5,159,791 | A | | 11/1992 | Juhas |
| 5,390,466 | A | | 2/1995 | Johnson et al. |
| 5,640,824 | A | | 6/1997 | Johnson et al. |
| 5,724,774 | A | | 3/1998 | Rooney |
| 5,822,936 | A | * | 10/1998 | Bateman ..... 52/281 |
| 5,846,128 | A | * | 12/1998 | Kramer ..... 454/229 |
| 5,864,992 | A | | 2/1999 | Bigelow |
| 5,893,241 | A | | 4/1999 | Schroeder |
| 5,916,096 | A | | 6/1999 | Wiesmann et al. |
| 6,085,470 | A | | 7/2000 | Bigelow |
| 6,088,969 | A | | 7/2000 | Bigelow |
| 6,112,473 | A | | 9/2000 | Pingel |
| 6,162,057 | A | | 12/2000 | Westphal et al. |
| 6,305,142 | B1 | | 10/2001 | Brisson et al. |
| 6,349,509 | B1 | | 2/2002 | Pingel |
| 6,415,557 | B1 | | 7/2002 | McCalley |
| 6,438,903 | B1 | | 8/2002 | Weiss |
| 6,457,281 | B1 | | 10/2002 | Teron |
| 6,722,195 | B2 | * | 4/2004 | Duke ..... 73/167 |
| 6,854,218 | B2 | | 2/2005 | Weiss |
| 6,862,847 | B2 | | 3/2005 | Bigelow |
| 6,890,023 | B2 | | 5/2005 | Preisler et al. |
| 6,951,079 | B2 | | 10/2005 | Weiss |
| 7,117,644 | B2 | | 10/2006 | Dehart |
| 2001/0039768 | A1 | | 11/2001 | Bigelow |
| 2002/0083653 | A1 | | 7/2002 | Hilbert |
| 2002/0100235 | A1 | | 8/2002 | Weiss |
| 2002/0108320 | A1 | | 8/2002 | Weiss |
| 2002/0129577 | A1 | | 9/2002 | Weiss |
| 2004/0206015 | A1 | | 10/2004 | Greenboim |
| 2004/0237418 | A1 | | 12/2004 | MacBeth |
| 2004/0237419 | A1 | | 12/2004 | MacWatt |
| 2005/0066590 | A1 | | 3/2005 | MacWatt |
| 2005/0247024 | A1 | | 11/2005 | Bedell et al. |
| 2005/0257479 | A1 | | 11/2005 | Nygren et al. |
| 2005/0284035 | A1 | | 12/2005 | DeOvando et al. |
| 2006/0080897 | A1 | | 4/2006 | O'Neal |
| 2006/0107985 | A1 | | 5/2006 | Sovine |
| 2006/0185260 | A1 | | 8/2006 | Dehart |
| 2006/0201085 | A1 | | 9/2006 | Dehart |
| 2006/0234069 | A1 | | 10/2006 | Sovine et al. |

FOREIGN PATENT DOCUMENTS

| | | | | |
|---|---|---|---|---|
| JP | 03095399 | A | * | 4/1991 |
| JP | 4097033 | | | 3/1992 |
| WO | WO 90/12933 | | | 11/1990 |
| WO | WO 93/20299 | | | 10/1993 |
| WO | WO 99/02793 | | | 1/1999 |
| WO | WO 00/22250 | | | 4/2000 |
| WO | WO 01/55517 | | | 8/2004 |
| WO | WO 2004/106656 | A1 | | 12/2004 |
| WO | WO 2004/106657 | A1 | | 12/2004 |
| WO | WO 2006/019391 | A2 | | 2/2006 |
| WO | WO 2006/104469 | A1 | | 10/2006 |

OTHER PUBLICATIONS

Range Consulting—ShootingSolutionsInc.com, information found at www.shootingsolutionsinc.com/range/mobilerange_building.html, © 2000 Shooting Solutions, Inc., 1 pg.

U.S Appl. No. 11/686,185, filed Mar. 14, 2007, Halverson.

U.S. Appl. No. 11/687,370, filed Mar. 16, 2007, Halverson.

* cited by examiner

MODULAR SHOOTING RANGE

RELATED APPLICATIONS

This application claims the benefit and priority of U.S. Provisional Patent Application Ser. No. 60/615,433, filed Oct. 1, 2004, entitled "Portable Firing Range", and also claims the benefit of and priority to U.S. Provisional Patent Application Ser. No. 60/692,402, filed Jun. 21, 2005, and entitled "Containerized Shooting Range", the disclosure of both applications are incorporated herein by this reference.

BACKGROUND OF THE INVENTION

1. The Field of the Invention

The present invention generally relates to facilities designed for weapons or firearms training and practice, commonly known as shooting ranges. More specifically, the present invention relates to modular shooting ranges that can be assembled, disassembled, and transported simply and efficiently.

2. The Relevant Technology

Existing shooting ranges are generally permanent facilities constructed on site. These ranges can be either outdoor or indoor shooting ranges. For outdoor shooting ranges permanent shooting stations, target areas, bullet stops, etc. are constructed on a large plot of land. Although outdoor shooting ranges are designed with safety are a primary consideration, there is, however, the possibility of injury to participants and onlookers within a large surface danger zone. For instance, participants, onlookers, and those unauthorized persons walking in the danger zone can be injured from accidental misfires which may not be directed toward the targets.

Noise also can be a problem with an outdoor shooting range. To alleviate this problem, many outdoor shooting ranges are initially located in a remote area. Unfortunately, the area surrounding the shooting range typically becomes developed for other commercial or for residential purposes. Various steps can be taken to lessen noise somewhat, but the only practical solution to encroachment may be to abandon the shooting range and construct a new range in another area. This can be expensive and time consuming to accomplish due to the significant environmental impact caused be embedded lead within the soil and the resultant clean-up costs associated with a move.

In addition to the above, outdoor ranges are typically only used when the weather permits. In cold climates the limited time during which the range may be used may not justify the cost of the large area required and the expense of construction.

To alleviate some of the above problems, another type of shooting range can be used, such as an indoor shooting range. These ranges are typically installed inside a building structure or the like. Again, a disadvantage of such shooting range is that it is stationary. Also the cost of operating such indoor ranges is high because of expense of building the structure or the necessary rental of the premises.

Still another type of mobile shooting ranges uses a modified tractor trailer. Unfortunately, this type of shooting range is not expandable in width or length. In addition, because of the elevated position of the compartment of the trailer, it is difficult. to access. Further, it is difficult to install the tractor trailer-type shooting range within a building due to the inclusion of the wheels and the height of the trailer.

BRIEF SUMMARY OF THE INVENTION

A need therefore exits for a shooting range system that can be inexpensive to operate and eliminates many of the problems associated with existing outdoor and indoor shooting ranges. The present invention generally relates to a shooting range system that is modular in construction to permit expandable capabilities and be moveable to allow for operation at alternative site locations. Advantageously, the modular shooting range system can be pre-engineered to enable simple and efficient movement of the shooting range system as needed. The shooting range system can be built at a location and be operational through simply providing electrical power to the modular shooting range system. The system can be designed with complete ventilation, optional removable panels, and a structure resistant to penetration by projectiles and inhibit ricochets.

One aspect is a system that uses modular shooting containers that can be mounted together to create a shooting range having any desired length and number of shooting positions. Advantageously, the modular shooting range system can be easily and efficiently expanded over time to provide flexibility with the types of weapons fired within the shooting range and the number of available shooting positions.

Another aspect is a system that limits the environmental impact caused by use of the modular shooting range system. Advantageously, the modular shooting range system can filter gases and airborne particles produced during firing of a weapon and can collect bullets, shot, and other projectiles for simple disposal. Harmful gases, airborne particles, or used bullets, shot, or projectiles can be collected and prevented from exiting the modular shooting range in an uncontrolled manner.

Still another aspect is a system that can be used for tactical training. Advantageously, each shooting container of the modular shooting range system can include one or more removable panels to allow access between adjacent shooting containers. This provides flexibility with the training scenarios used with the modular shooting range system and so provides a system to increase the readiness of those using the modular shooting range system.

Yet another aspect is a system that can be safely transported without damaging the shooting containers or modules of the modular shooting range system. With each shooting container or module pre-engineered for structural integrity when one or more of the panels are removed, the modular shooting range system can still be disassembled, transported, and re-assembled without damaging each shooting container.

In one embodiment, the system can include a shooting container having a one or more shooting positions from which individuals can shot firearms, means for collecting bullets, shot, or projectiles shot from the firearm, and means for ventilating the air and gases within the shooting container. Optionally, the shooting container can include removable panels to enable users of the shooting container to move between shooting containers positioned adjacent one to another during tactical training and usage of the modular shooting system.

In another embodiment the system can include one or more shooting containers that can mount together to create one or more shooting lanes from which an individual can fire a weapon. A first shooting container can include one or more shooting positions, while a second shooting container can include means for collecting one or more bullets or projectiles received from the first shooting container. Depending upon the particular length of the system, one or more intermediate shooting containers can be disposed between the first shooting container and the second shooting container. Mountable to the first shooting container, the second shooting container, and/or the one or more intermediate shooting containers is a ventilation system that filters gases and particulates generated through use of the modular shooting range system.

In still another embodiment of the system, a control booth is connected to one or more shooting modules and allows a range controller to operate any or all of the electrical, lighting, cooling, heating, or target retrieval systems within the shooting range system. The control booth may be integrally manufactured with the one or more shooting modules, and may have removable panels such that it is expandable as additional shooting modules are added. Alternatively, the control booth can be a separate module which is later connected to the one or more shooting modules. In either configuration, the environment of the control booth can be separated from the shooting module environment, and the control booth can have a separate heating, cooling, and/or ventilation system.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE EMBODIMENTS

The present invention generally relates to a shooting range system that is modular in construction to permit expandable capabilities and be moveable to allow for operation at alternative site locations if needed. Through simply providing electrical power, the modular shooting range system can be operational for use. The system can be designed with complete ventilation, optional removable panels, and a structure resistant to penetration by projectiles and inhibit ricochets.

Figure 1:
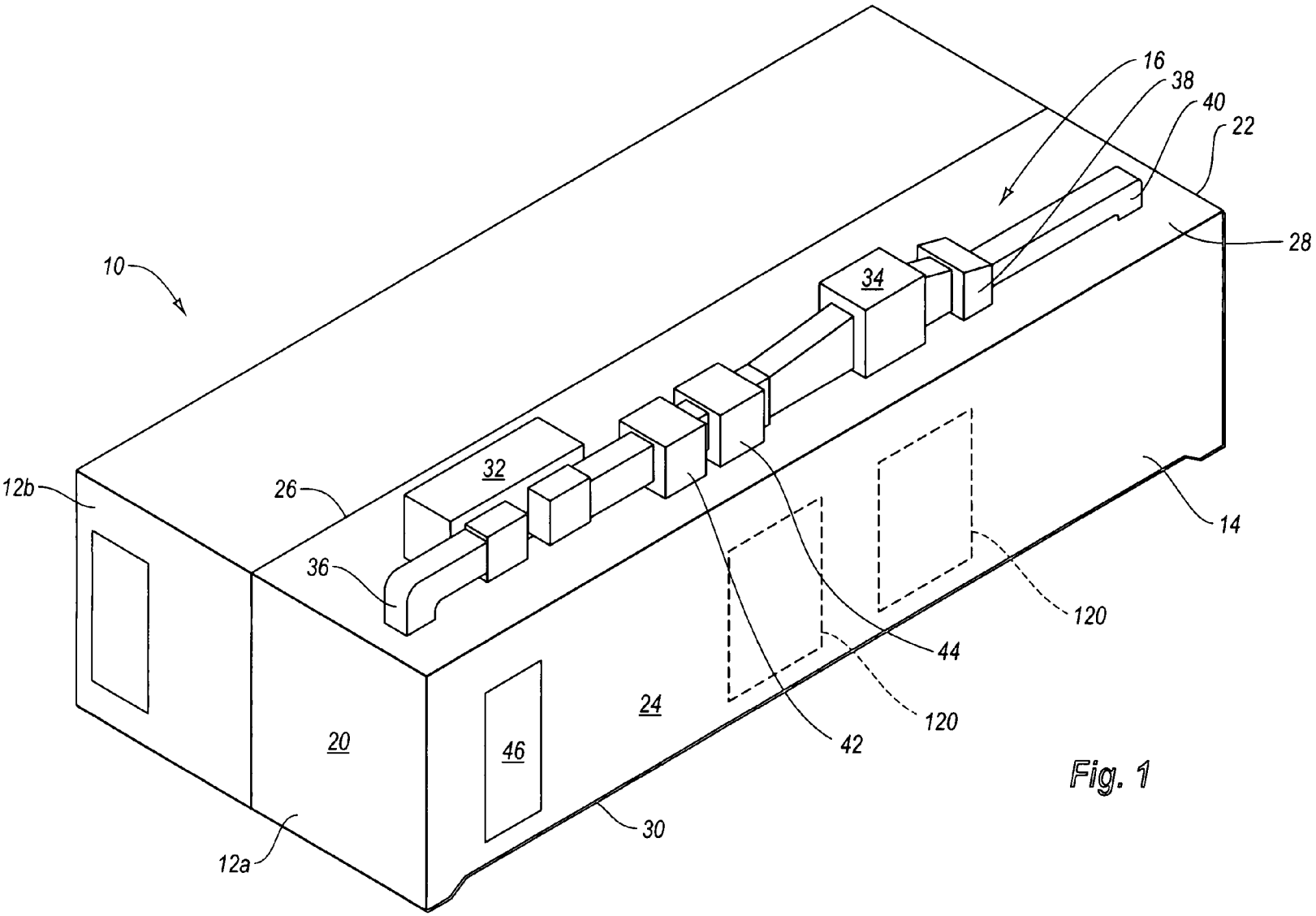
FIG. 1 illustrates a perspective view of a system according to one embodiment of the present invention.

Turning to FIG. 1, illustrated is a perspective view of a shooting range system 10 according to the present invention. As illustrated, shooting range system 10 includes two shooting range modules; a first shooting range module 12*a* and a second shooting range module 12*b*. These shooting range modules 12*a* and 12*b* are mounted together to create the shooting range system 10 and provide flexibility to indoor training and testing. Although two shooting range modules 12*a* and 12*b* are illustrated, it can be understood by those skilled in the art that the shooting range system 10 can include one or more shooting range modules. The shooting range system 10 of FIG. 1 is illustrated in an expanded width configuration; however, other shooting range module configurations enable the shooting range system to expand to varying widths, lengths, and optionally heights.

The following discussion will be directed to the first shooting range module 12*a*, however a similar discussion may be made for the second shooting range module 12*b*. As such, in the discussion of FIG. 1 we shall use the phrase "shooting range module 12" to refer to either of the first shooting range 12*a* or the second shooting range 12*b*.

As illustrated, shooting range module 12 can include a shooting container 14 to which is mounted a ventilation system 16. The shooting container 14 can have a general elongated configuration having a first end 20, a second end 22, walls 24 and 26, and a top and bottom 28 and 30, respectively. In one configuration, the shooting container 14 is a modified shipping container having varying lengths, widths, and heights. The shipping container or the shooting container 14 can be fabricated from a metal, metal alloy, or other material sufficient to provide the desired strength and rigidity and provide some resistance to bullets, shot, or projectiles fired at the first end 20, the second end 22, the walls 24 and 26, the top 28, and the bottom 30.

Mounted to the top 28 is part of the ventilation system 16. The ventilation system 16 can include a heating and air conditioning system 32, optionally with an integral or separate intake fan, which can cool or heat air that is directed to an interior of the shooting container 14 by way of an inlet duct 36. This air, and any gases and airborne particles generated through use of the shooting system 10, can be removed from the interior of the shooting container 14 and filtered using a filter 34 and ducts 38 and 40. With this configuration, the interior of the shooting container 14 can be heated, cooled, and the air within ventilated to prevent particles and gases from being incident upon an individual using or outside the shooting range system 10 of the present invention.

The heating and air conditioning unit 32 can receive air from outside the ventilation system 16, such as by way of an inlet port 42. A fan 44 disposed between the inlet port 42 and the filter 34 can aid in drawing the air, airborne particles, and gases from within the shooting container 14 and optionally aid with drawing air from outside the ventilation system 16 into the ventilation system. Optionally, the fan 44 can function as the air intake fan associated with the heating and air conditioning unit 32.

The filter 34 can be a High-Efficiency Particulate Air (HEPA) filter with up to 99.9% HEPA quality air. Air passed through the filter 34 will be exhausted with no hazardous lead or other airborne contaminant. This provides an environmentally safe shooting range system 10 and provides the desired air quality for the safety of the shooter, instructor, and those outside the shooting range system 10. In one configuration, the filter 34 can filter the air within the shooting container 14 at 2000 cubic feet per minute.

It will be understood that other filtration systems or techniques and flow rates higher or lower than 2000 cubic feet per minute are possible. For instance, in another configuration, other mechanical air filters, electronic or electrostatic air cleaners, gas-phase adsorption devices, ultraviolet systems, or combinations thereof can be used to clean and/or purify the air removed from the interior of the shooting container 14.

Formed in wall 24 of shooting container 14 is a door 46 to provide access to its interior. According to the present invention, the door 46 can be a double-swing or single-swing door. Alternatively, the door 46 can take the form of two separate doors that control access to the interior of the shooting container 14. For instance, an individual wishing to enter the shooting container 14 will need to open both doors to gain access. This provides additional safety to those entering and exiting the shooting container 14 and also aids with bullet safety and sound attenuation.

Disposed in close proximity to the door 46 is a "Range in Use" light 48. This light 48 can be illuminated to notify those individuals outside the shooting range system 10 that individuals are shooting or firing weapons within the shooting container 14. It can be understood that upon illuminating the light 48, the door 46 can automatically lock to prevent unwanted access to the interior of the shooting range system 10 and limit the possibility of unauthorized access and potential injury.

Figure 2:
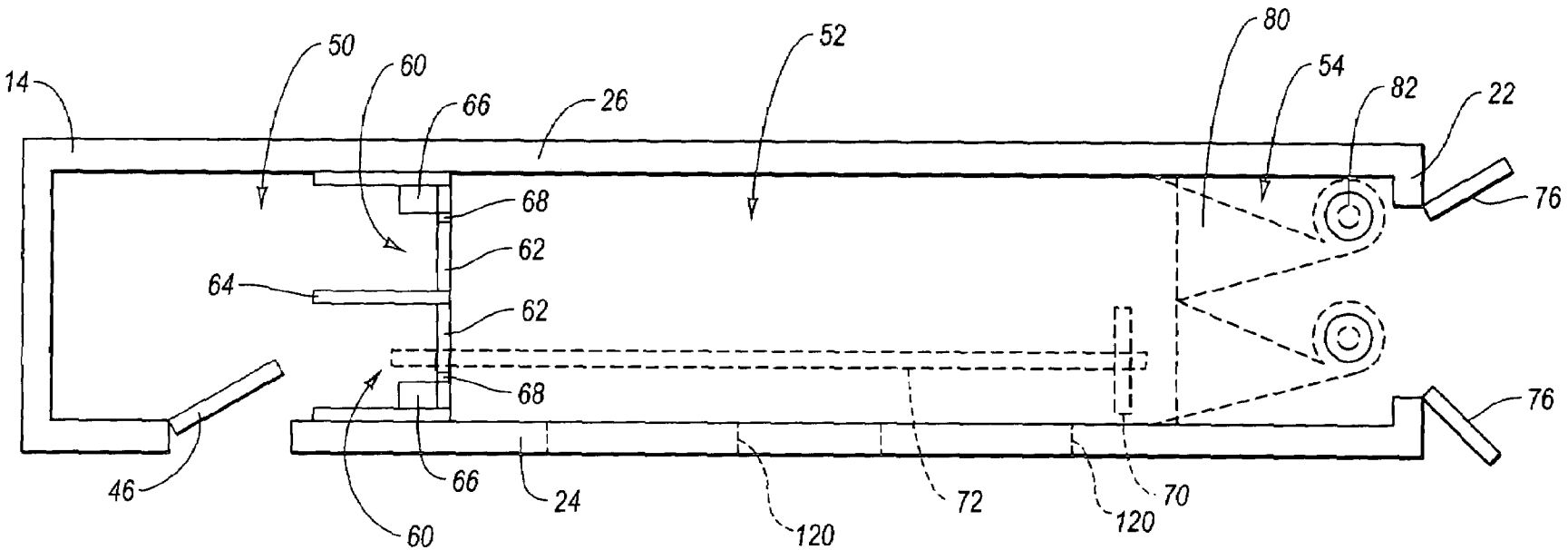
FIG. 2 illustrates a cross-sectional top view of a shooting container of the system of FIG. 1.

Turning to FIG. 2, illustrated is an exemplary interior of the shooting container 14 of the present invention. The interior of the shooting container 14 is generally split into three portions; a first portion 50 from which an individual can fire a weapon, a second portion 52 through which a bullet, shot, or projectile is fired, and a third portion 54 having means for collecting the bullet, shot, or projectile. The first portion 50 can include two firing positions 60 from which an individual can fire a weapon. This results in the shooting container 14 having two shooting lanes. It will be understood that the shooting container 14 can include a greater or lesser number of firing positions 60 and so number of shooting lanes.

As illustrated in FIG. 2, each firing position 60 can include an overturning or removable support 62 used to support the weapons fired from the shooting position 60. Separating the two shooting positions 60 can be a dividing wall 64, with optionally walls mounted to the walls 24 and 26 of shooting container 14. The dividing wall 64 can be made from bullet-proof and/or anti-rebound material and can also optionally be made of sound-absorbing material. For instance, in one configuration, the dividing wall 64 and the other walls forming part of the shooting station 60 can be manufactured to a level 3 bullet resistant level.

Optionally located at each shooting station 60 are (i) a monitor 66 to view one or more targets 70 located in close proximity to the end of the second portion 52, and (ii) a controller 68 to control the lighting, air temperature, air pressure, filter usage, and position of the one or more target 70. For instance, the controller 68 can operate an electronic target retrieval system 72, such as a movable track, suspended from the ceiling of the shooting container 14 to move the one or more targets 70 and to vary the position of the one or more targets 70 for distance adjustment in live fire training. This eliminates the need for the shooter to travel down range for target shooting. Only one target 70 and one electronic target retrieval system 72 are depicted in FIG. 2; however, those skilled in the art will appreciate that various other numbers of electronic target retrieval systems and targets can be used.

It can be understood that the first portion 50 can include a separate monitor 66 and controller 68 operable by an instructor or operator of the shooting range system 10 (FIG. 1). In this manner, the instructor or operator, rather than and optionally in addition to those individuals firing from the shooting positions 60, can control and monitor the lighting, air temperature, air pressure, filter usage, and position of the one or more target 70.

In addition to the above, each shooting position 60, and optionally the first portion 50, can include a noise suppression mat upon which the shooter can stand while firing his/her weapon. This mat can both suppress noise and provide comfort to the shooter. In one configuration, the mat can be a rubber mat. More generally, any material that can provide the desired comfort to the shooter and noise reduction or suppression can be used.

Figure 3:
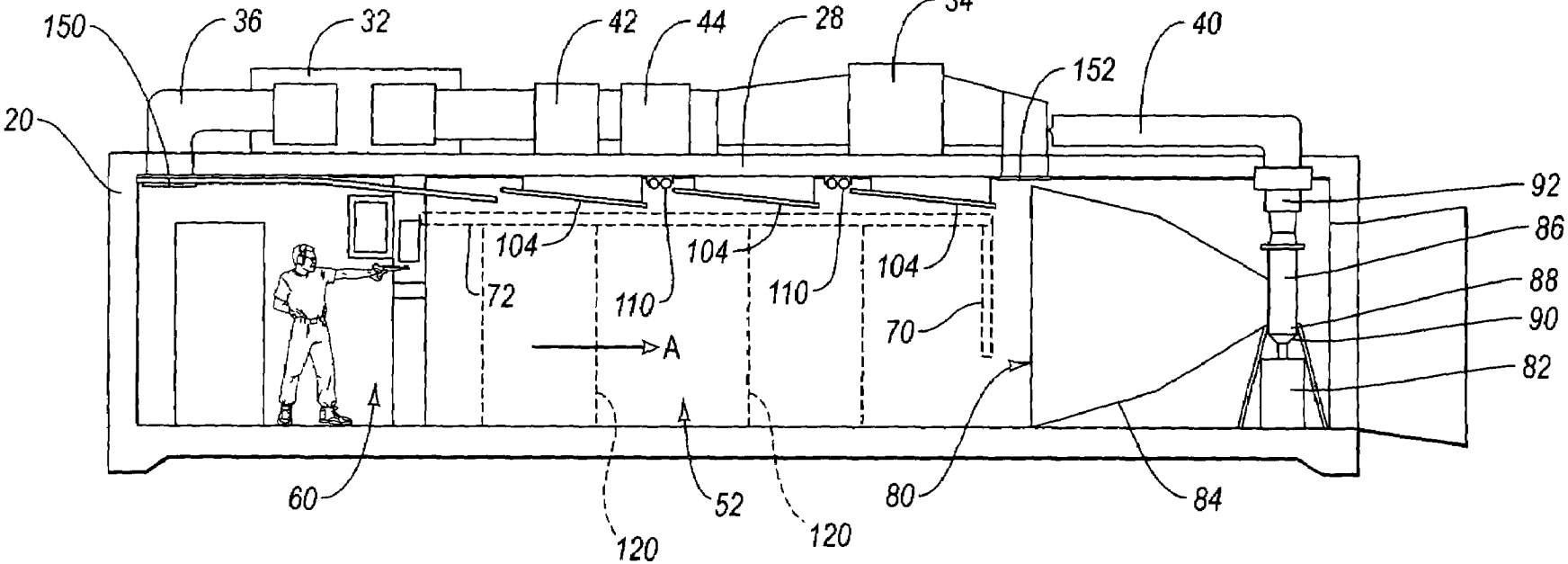
FIG. 3 illustrates a cross-sectional side view of the shooting container of FIG. 2.

As illustrated in FIG. 3, disposed between the first portion 50 and the third portion 54 is the second portion 52. This second portion 52 aids with directing bullets, shots, or projectiles toward the means for collecting the bullets, shots, or projectiles and providing desired shooting conditions for training. Disposed within the second portion 52, and optionally the first portion 50 and the third portion 54 are a plurality of deflector assemblies 100. Each deflector assembly 100 aids to direct misdirected bullets, shots, or projectiles towards the third portion 54.

The deflection assembly 100 can include a support structure 102 that mounts a deflector structure 104 to the top 28 of the shooting container 14 in an inclined fashion, such as but not limited to an angle of thirty degrees. With the incline of the deflector plates 104 being generally inclined in the direction that bullets, shot, or projectiles traverse the second portion 52, i.e., in the direction of arrow A, any bullets, shot, or projectiles hitting the deflector plates 104 are directed towards the bullet trap 80.

The support structure 102 can be any structure that can support and aid with mounting the deflector structure 104 to the shooting container 14, such as, but not limited, to brackets, mechanical fasteners, adhesives, welds, or other device(s) and/or techniques for mounting one structure to another structure. Optionally, the support structure 102 can be used to vary the angular orientation of the deflector structures 104 relative to each other and to the top 28 of the shooting container 14. For instance, although reference is made to the angular orientation of the deflector structures 104 being thirty degrees, it will be understood that angular orientations larger and smaller than thirty degrees are possible so long as the deflector structures 104 direct an bullet, shot, or projectile down range toward the means for collecting the bullets, shots, or projectiles.

The deflector structure 104 can be fabricated from a steel plate, such as 9 gauge steel to ⅜ AR 500. In one configuration, the deflector structure 14 has a sandwich configuration with one or more layers of metal, such as but not limited to steel, fiber board, safety wood, and sound proofing or controlling material or noise absorbing material or barriers. For instance, each deflector structure 104 can be at least partially covered with acoustical foam or material sold under the trademark SONEX or any other sound proofing or controlling material or noise absorbing material or barriers. It will be understood that in other configurations the deflector structure 104 can be fabricated from one or more of the above-mentioned materials, so that the deflector structure 104 is fabricated from one or more layers.

As mentioned above, the second portion 52 can include various structures to help direct the bullets, shots, and projectiles to the third portion 54. These structures direct the bullets, shots, and projectiles toward a means for collecting the bullets, shots, or projectiles disposed at the third portion 54. The end 22 of the shooting container 14 can include one or more doors 76 to provide access to the means for collecting bullets, shot, or projectiles. In one configuration, the means for collecting bullets, shot, or projectiles can be one or more bullet traps 80 accessible through the doors 76. Each bullet trap 80 changes the forward inertia and velocity of the bullet, shot, or projectile into rotational motion that allows gravity to force the bullet, shot, or projectile to drop into a removable collecting canister 82.

The bullet trap 80 can include a funnel-shaped inlet 84 that receives and guides the bullet, shot, or projectile to a collection chamber 86. As a bullet, shot, or projectile enters the collection chamber 86, helical structures (not shown) within the collection chamber 86 change the forward velocity to rotational motion that decelerates the bullet, shot, or projectile until it falls to a lower portion 88 of the collection chamber 86 and exits into the collecting canister 82 through a funnel 90 or other structure capable of directing the bullet, shot, or projectile from one structure to another structure. When the collecting canister 82 is full, it can be replaced with an empty collecting canister.

Mounted to an upper portion 92 of the collection chamber 86 is the duct 40. As the bullet, shot, or projectile traverses the collection chamber 86 any generated airborne particles, dust, or gases can be removed from the collection chamber 86 by the ventilation system 16. This eliminates any airborne particles and gases that can be hazardous to an individual operating or using the shooting range system of the present invention.

With the configuration described above, the lead associated with the bullets, shots, or projectiles can be safely collected and subsequently disposed with the minimum of effort and without hazard to the operator of the shooting range system. This complies with regulations for the training of both military and law enforcement personnel and preventing contamination of soil, air and water near the shooting range system.

Optionally mounted within the interior of the shooting container 14, such as within the first portion 50, the second portion 52, and/or the third portion 54, is a plurality of lights 110. Lights 110 provide illumination to the shooter located at shooting position 60. These lights 110 can be of various types, such as fluorescent, halogen, or any other type of device to illuminate at least a portion of the interior of the shooting container 14 for at least a period of time. Optionally, the lights 110 can have the form of a strobe light such that shooting practice and training may be performed in the dark with a strobe light operating. This provides a different environment for the shooter to practice and be tested. 10511 To provide electrical power to the shooting range module 12 and the associated ventilation system 16 (FIG. 1), monitors 66 (FIG. 2), controllers 68 (FIG. 2), electronic target retrieval system 72 (FIG. 2), lights 110 (FIG. 3), and other devices requiring electricity, the shooting range module 12 can include one or more electrical panels (not shown), optionally a main outside main panel and interior sub panel, with associated electrical disconnects and breakers. By providing electricity to the single main outside main panel, electricity is provided to the entire shooting range module 12.

As mentioned before, the first end 20, the second end 22, the wall 24 and/or the wall 26 of the shooting container 14 can be engineered with one or more removable panels 120 to enable access between adjacent shooting containers 14, such as between the first shooting range module 12*a* and the second shooting range module 12*b*. With these one or more removable panels 120, the shooting range system 10 (FIG. 1) is expandable in width to accommodate various number of firing lanes and allows for expansion of the shooting range system 10 (FIG. 1) to accommodate any number of adjacently positioned shooting range modules.

These one or more removable panels 120 can be removed to provide an access opening for a door between adjacently positioned shooting range modules. With doors or accessing openings having various widths positioned at any location along the length of the shooting range module, the shooting range module can be used for tactical training. Once a removable panel 120 is removed, the resultant opening can be filled with a door or other structure or unfilled to allow unimpeded access to an adjacently positioned shooting range module. The shooting range system 10 (FIG. 1), therefore, can be used not only as a lane-type shooting range but as a true fire training facility that simulates urban warfare, building clearing, tactical assaults, and other training exercises.

The area of the shooting container 14 around the panels 120 is pre-engineered and constructed to prevent damage to the shooting container 14 during transporting, assembling, and disassembling. This is unlike any other portable range. Other indoor shooting ranges are assembled and then cutouts and access are created on site, making the structure unsound to move. With the shooting container 14 pre-engineered for assembly, disassembly, and transporting as many times as needed, the shooting container 14 remains structurally safe to move and use.

Various manners are provided to enable the panels 120 to be removable. For instance, the panels 120 can be bolted onto the shooting container 14 and removed as needed. In other configurations, the panels can be welded onto the shooting container 14 and removed as needed.

Figure 4:
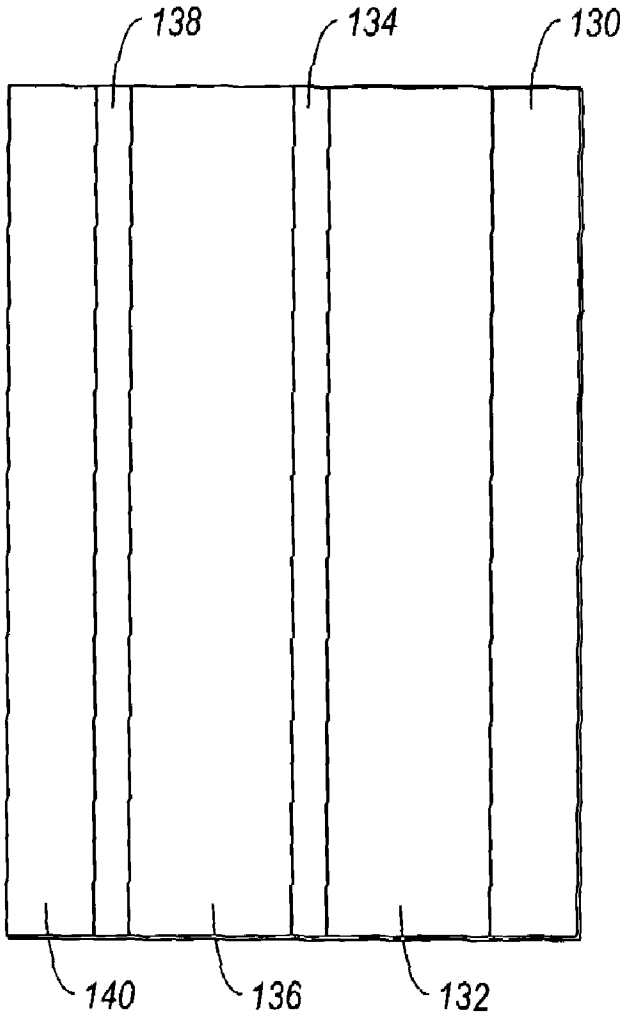
FIG. 4 illustrates a cross-sectional view of a wall of the shooting container of FIGS. 2-3.

To provide bullet, shot, or projectile resistance, each of the first end 20, the second end 22, the walls 24 and 26, and the top and bottom 28 and 30 can have a layered construction, as illustrated in FIG. 4. This layered construction can (i) prevent bullets, shot, and projectiles penetrating the shooting container 14, (ii) reduce the noise heard by individuals outside the shooting container 14, and (iii) provide a finished exterior coating per customer requests.

To achieve the above, the first end 20, the second end 22, the walls 24 and 26, and the top and bottom 28 and 30 can include an exterior finish layer 130 disposed on an insulation layer 132, which is in turn disposed on a container wall 134. Another insulation layer 136 can be disposed on the container wall 134, with a bullet, shot, or projectile resistant layer 138 disposed on the insulation layer 136 and an optional sound proofing or controlling or noise absorbing or reducing layer 140, such as the layer associated with the deflector structure 104 (FIG. 3), disposed on the bullet, shot, or projectile resistant layer 138. It will be understood that the order of the layers described herein can be varied based upon the particular configuration of the shooting container 14. In addition, other layers can be included in the layered construction of the first end 20, the second end 22, the walls 24 and 26, and the top and bottom 28 and 30. For instance, an extra bullet, shot, or projectile resistant layer can be disposed between the insulation layer 136 and the container wall 134. Similarly, a second container wall, with associated insulation, can be disposed between the container wall 134 and the insulation 132. Further, the optional sound proofing or controlling or noise absorbing or reducing layer 140 can optionally be substituted with a rubber protection layer that can aid with reducing in ricochets.

Generally, the exterior finish layer 130 can be made from any material selected by a customer of the shooting range system 10 (FIG. 1). For instance, the exterior finish layer 130 can be a polymer siding, such as those provided under the trademark KYNAR. In other configurations, any polymeric or metallic products usable to cover the insulation 132 and prevent wind, water, and other weather elements contacting the insulation 132.

Turning to the insulation layers 132 and 136, these can be made from any material or combinations of materials that function to insulate or to prevent the passage or heat, electricity, or sound through the surface(s) to which the material is mounted. In one configuration, the insulation can be, for instance, and not by way of limitation, fiberglass, rockwool, cellulose, polystyrene, polyurethane, polyisocyanurate, vermiculite, perlite, or other types of insulating material.

With respect to the container wall 134 and the bullet, shot, or projectile resistant layer 138, these layers can be made from metallic plates or panels. The container wall 134 can be fabricated from a material, such as steel, that is bullet, shot, or projectile proof to a 9 mm bullet at point blank fire. Similarly, the bullet, shot, or projectile resistant layer 138 can be fabricated from a material, such as steel, that is bullet, shot, or projectile proof to 7.62 by 39 rifle bullet at point blank fire. More powerful calibers can be accommodated by varying the number of layers and armor resistant material used. In one configuration, the bullet, shot, or projectile resistant layer 138 can be 9 gauge up to ⅜ inch plate steel with an optional smooth finish. More generally, the bullet, shot, or projectile resistant layer 138 can be made from a material with a Brinell rating based upon the type of weapon being used. For instance, the bullet, shot, or projectile resistant layer 138 can having a Brinell rating of 400 or 500 depending upon the particular pistol or rifle being used within the shooting container 14. The particular bullet, shot, or projectile resistant layer 138 can have sufficient structural integrity to resist penetration by bullets, shots, or projectiles and optionally inhibit rebounding bullets, shots, or projectiles while serving as a guiding mechanism to keep bullets, shots, or projectiles traveling down range, in the direction of arrow A (FIG. 3).

Returning to FIG. 3, mounted to the top 28 of shooting container 14 is the ventilation system 16. The top 28 can be optionally pitched to aid with directing water, snow, ice, etc. from the ventilation system 16. The inlet duct 36 of the ventilation system 16 can pass air into the interior of the shooting container 14 through an inlet register or grill 150 in close proximity to the first portion 50 and behind the shooting position 60. Alternatively, or in addition to inlet register or grill 150, an air-wall can be disposed between the first end 20 and shooting position 60; the air-wall including a plurality of holes or perforations through which the air can flow. In one configuration, the air-wall is a polymer panel having a plurality of holes or perforations; however, one skilled in the art will appreciate that various other configurations of the air-wall are possible and may be known to those skilled in the art in light of the teaching contained herein.

Exhaust gases and airborne particles can be removed from the interior of the shooting container 14 by way of an outlet grill 152 disposed in close proximity to the bullet traps 80. The air delivered to the inlet register 150 can be pressurized so that an air-wall is created behind the shooting positions 60. This provides a laminar air flow of a rate of approximately 50 to 75 feet per minute down range in the direction of arrow A, which meets the U.S. Navy's new 2004 indoor range requirements. This results in no airborne particles or other materials being incident to the shooter at the shooting position 60.

Figure 5:
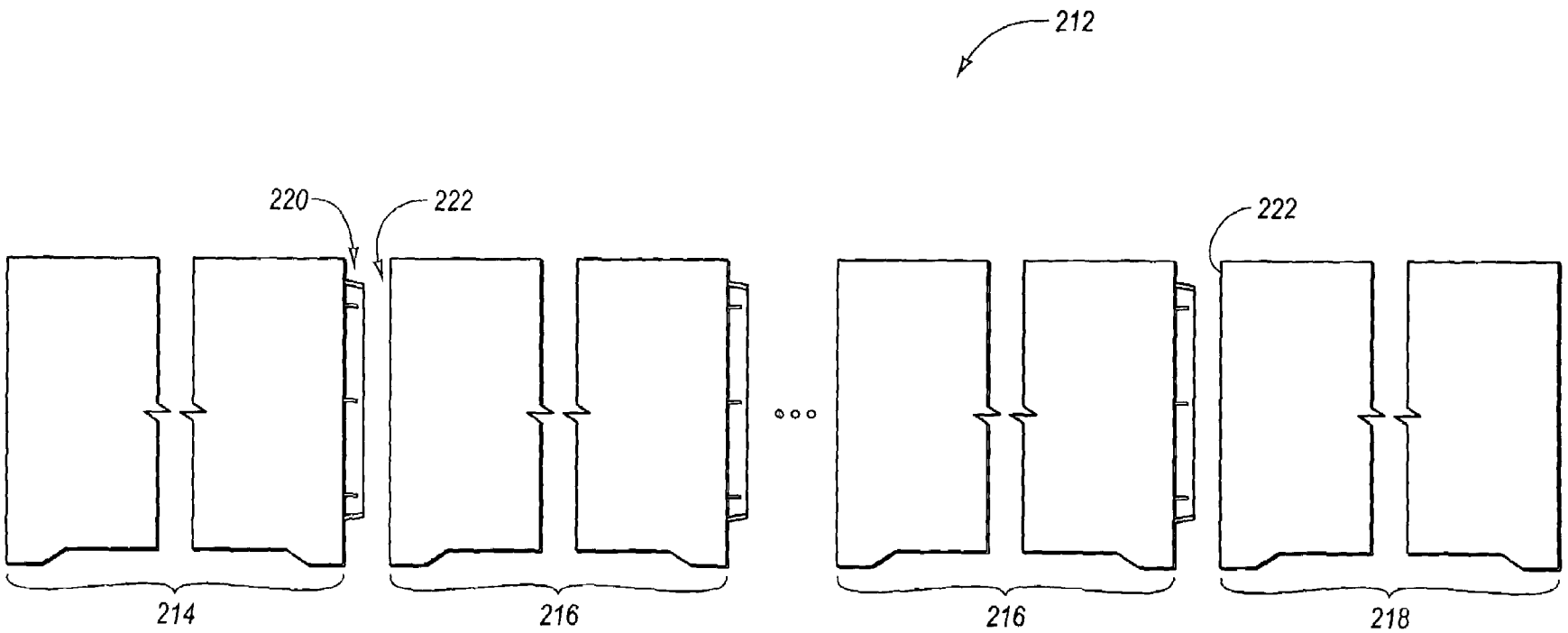
FIG. 5 illustrates a side view of another system according to the present invention.
Figure 6:
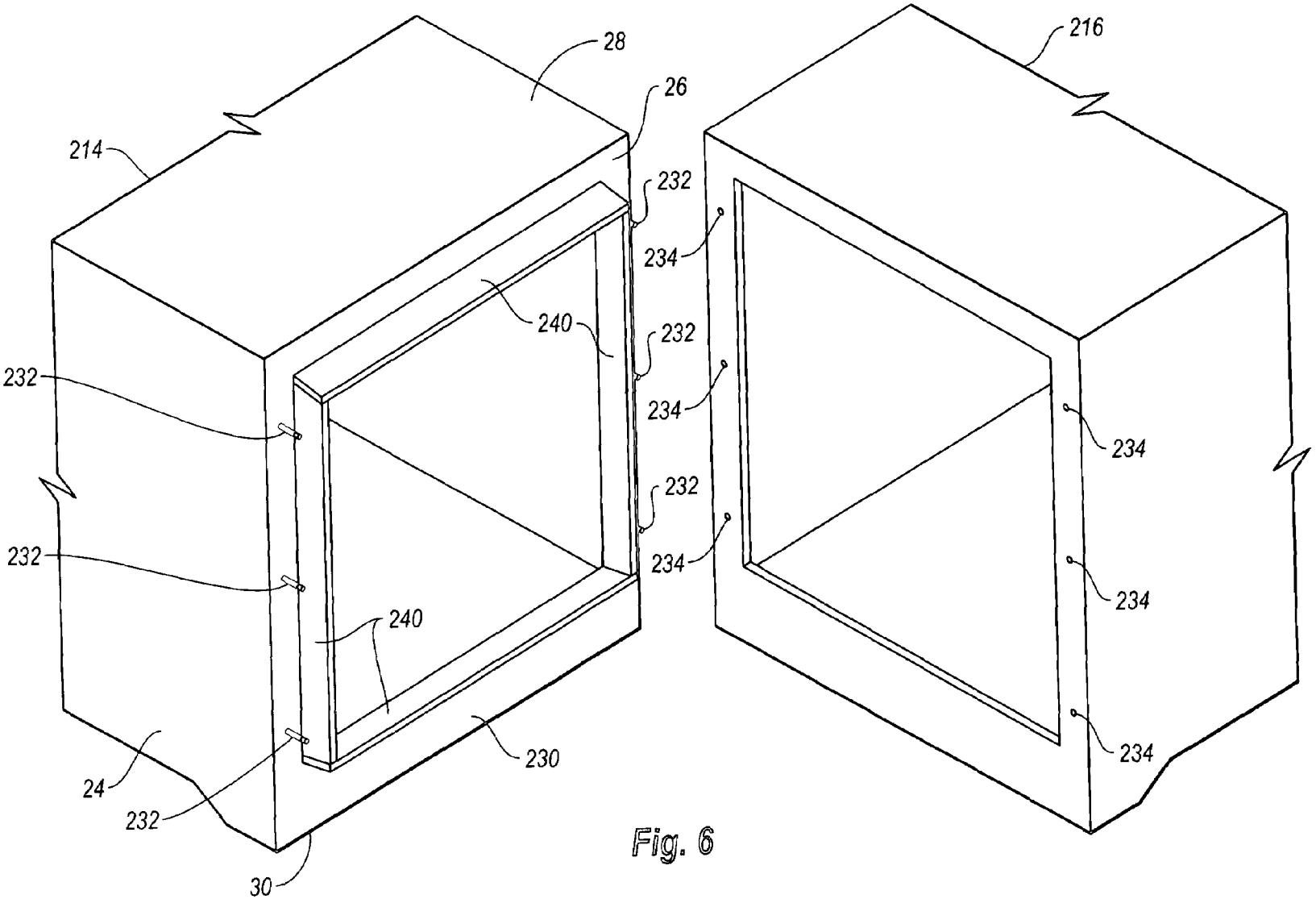
FIG. 6 illustrates an perspective view of the male-type connection and the female-type connection of the system of FIG. 5.
Figure 7:
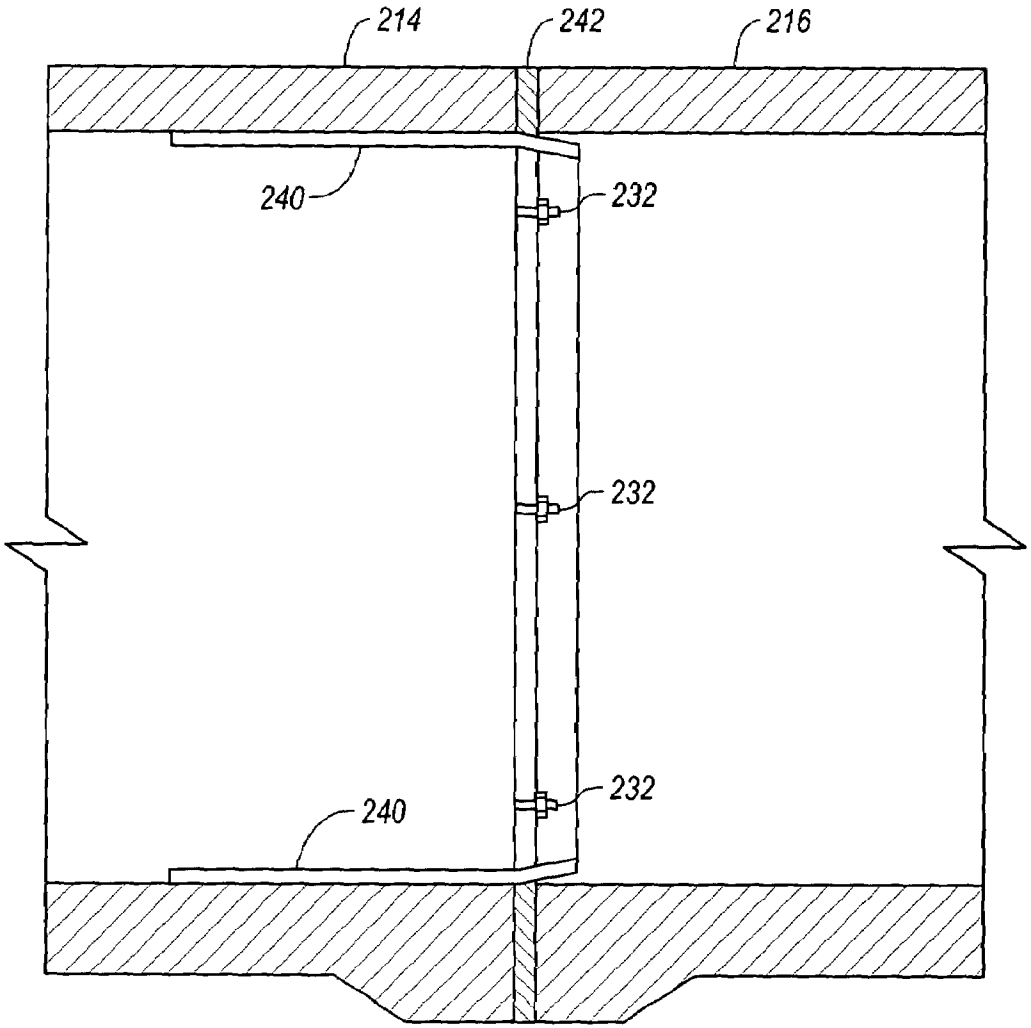
FIG. 7 illustrates a cross-sectional side view of the system of FIG. 5 of the present invention.

As mentioned before, using the shooting range system of the present invention the length and width of the shooting range can be varied based upon the particular requirements of the customer. For instance, the number and length of the shooting lanes can be varied due to the modular characteristics of the shooting range system. The embodiment described with respect to FIG. 1-4 illustrates a manner for increasing the width of the shooting range system, illustrated in FIGS. 5-7 are the components of the shooting range system that enable the length of the shooting lanes to be increased. It can be understood that the functions and features of the system illustrated in FIGS. 5-7 can apply to the system described in FIGS. 1-4.

Turning to FIG. 5, illustrated is another configuration of the shooting range system 10. The shooting range system can include one or more shooting range modules 212, only one being illustrated in FIG. 5. One or more shooting range modules 212 can be mounted together in a similar manner to that illustrated in FIG. 1 with shooting range system 10 to create the shooting range system and provide flexibility to indoor training and testing, such as described above with respect to shooting range system 10 (FIG. 1). For ease of illustration, the ventilation system 16 is omitted from FIGS. 5-9.

The illustrated shooting range module 212 of FIG. 5 can include a first end shooting module 214, a second end shooting module 218, and one or more intermediate shooting modules 216. Each shooting module 214, 216, and 218 can include the shooting container 14, which can be a modified shipping container having varying lengths, widths, and heights. The shipping container can be fabricated from a metal, metal alloy, or other material sufficient to provide the desired strength and rigidity and provide some resistance to bullets, shot, or projectiles fired within an interior thereof.

These modules 214, 216, and 218 can mount together to create one or more shooting lanes and an area to perform tactical training. For instance, a customer can select the width and length, and optionally height, of the shooting range system and the desired number of modules 214, 216, and 218 can be brought to customer site in sections via a flatbed trailer and set in place using cranes, forklift vehicles, etc. These modules 214, 216, and 218 are pre-engineered to enable disassembly, transportation, and reassembly as many times as needed without damaging the structural integrity of the shooting range system. This is in contrast to existing indoor systems that are modified on-site and reduce the structure integrity to allow numerous disassemblies, transportations, and reassemblies.

With this modular configuration, the length of the shooting range system and the shooting range module 212 can be varied from forty feet to greater than one hundred feet. It will be understood that the particular length of the shooting range system can be selected based upon the particular shipping containers used to achieve the customer's desired configuration. It will be also understood that that particular length of the shooting range system can be greater or lesser than one hundred feet and/or forty feet.

Mounted to one or more of the first end shooting module 214, the one or more intermediate modules 216, and the second end shooting module 218 is the ventilation system that can heat and cool and remove gases and airborne particles from the interior of the shooting range module 212. It will be understood that any portion of the ventilation system can be elongated to accommodate for changes in the length of the shooting range module 212. For instance, ducts of different lengths can be added to the ventilation system 16 to accommodate for changes in the length of the shooting range module 212. The filter, fan, or heat and cooling components of the ventilation system 16 can be optionally elongated or be added thereto to accommodate for changes in the length of the shooting range module 212.

Generally, the first end shooting module 214 and the second end shooting module 218 can have a similar configuration, respectively, to the first portion 50 and the third portion 54 of the shooting range module 12 (FIG. 1). As such, the first end shooting module 214 can include one or more firing positions, monitors, controllers, walls, etc, while the second end shooting module 218 can include the means for collecting the bullets, shots, or projectiles, such as but not limited to one or more bullet traps. Each of the one or more intermediate shooting range modules 216 can include the structures associated with the second portion 52 of the shooting range module 12*a* (FIG. 1), such as but not limited to, one or more deflector assemblies 100, removable panels 120, lights 110, targets 70, and electronic target retrieval systems 72.

To enable mounting of the modules 214, 216, and 218 together, each module 214, 216, and 218 can include one or two complementary ends so that adjacently positioned modules can mount together. For instance, the first end shooting module 214 can include a male-type connector 220 and the second end shooting range module 218 can include a female-type connector 222. In this example, each of the intermediate modules 216 can include one male-type connector 220 and one female-type connector 222. It will be understood, however, that various other combinations of connectors 220 and 222 are possible. For instance, the intermediate modules 216 can include two male-type connectors 220, two female-type connectors 222, or one of each connector 220 and 222. Similarly, the first end shooting module 214 can include a female-type connector 222 and the second end shooting range module 218 can include a male-type connector 220.

Reference will know be made to FIGS. 6 and 7, which illustrates portions of the first end shooting module 214 and one of the intermediate modules 216 and the associated male-type and female-type connectors 220 and 222. It will be understood that a similar discussion can be made for two intermediate modules 216, the first end shooting module 214 with the second end shooting module 218, and/or the intermediate module 216 with the second end shooting module 218.

As illustrated in FIG. 6, extending from a first end 230 of the first end shooting module 214 is a plurality of connector members 232. As illustrated, the connector members 232 extend from the walls 24 and 26 of the first end shooting module 214. These connector members 232 can be threaded and can be received in complementary openings 234 formed in an adjacently positioned intermediate module 216. These connector members 232 can be integrally formed with or mounted to the first end shooting module 214, such as but not limited to, through welding, mechanical fasteners, complementary engagement structures, such as, but not limited, to threads, interference fits, etc., or other techniques or structures for mounting one structure to another structure. The connector members 232 and the openings 234 are illustrated in the ends of the walls 24 and 26; however, it will be understood that the connector members 232 and openings 234 can be associated with the top 28 and the bottom 30 of the shooting container 14 of the shooting range module 212.

In addition to the connector members 232 extending from the first end shooting module 214, one or more overlapping members 240 extend from an interior of the first end shooting module 214 into an interior of the intermediate module 216. These overlapping members 240 can aid with aligning the connector members 232 with the openings 234. In addition, since the overlapping members 240 can be fabricated from material having a degree of resistance to bullets, shot, or projectiles, such as but not limited to similar materials to those of the shooting container 14 (FIG. 1), the bullet, shot, or projectile resistant layer 138 (FIG. 4), and/or the deflector structure 104 (FIG. 3), the overlapping members 240 provide resistance to the junction of the first end shooting module 214 and the intermediate module 216. With the overlapping members 240 optionally being inclined, the overlapping members 240 can direct any bullets, shot, or projectiles towards the end of the shooting range module 212 and the associated means for collecting the bullets, shot, or projectiles.

Turning to FIG. 7, illustrated are the first end shooting module 214 mounted to the intermediate module 216. A gasket 242 can be disposed between the first end shooting module 214 and the intermediate module 216 to limit the possibility of water and wind penetration into the interior of the shooting range module 212 (FIG. 5). This gasket 242 can be fabricated from various materials so long as it can limit the infiltration of water, snow, ice, wind, etc. into the interior of the shooting range module 212.

The combination of the gasket 242 and the overlapping members 240 can aid with installation of the shooting range module 212 (FIG. 5) by accommodating for variations in the position and orientation of the first end shooting module 214 and the intermediate module 216. Since the overlapping members 240 extend part way into an interior of the intermediate module 216 the position of the first end shooting module 214 from the intermediate module 216 can be varied up to the limit of the length of the overlapping members 240 extendable into the interior of the intermediate module 216. The resultant space between the first end shooting module 214 and the intermediate module 216 can be filled with one or more gaskets 242, each being fabricated from the same or different materials. This enables simple and efficient installation of the shooting range module 212 of the present invention.

Figure 9:
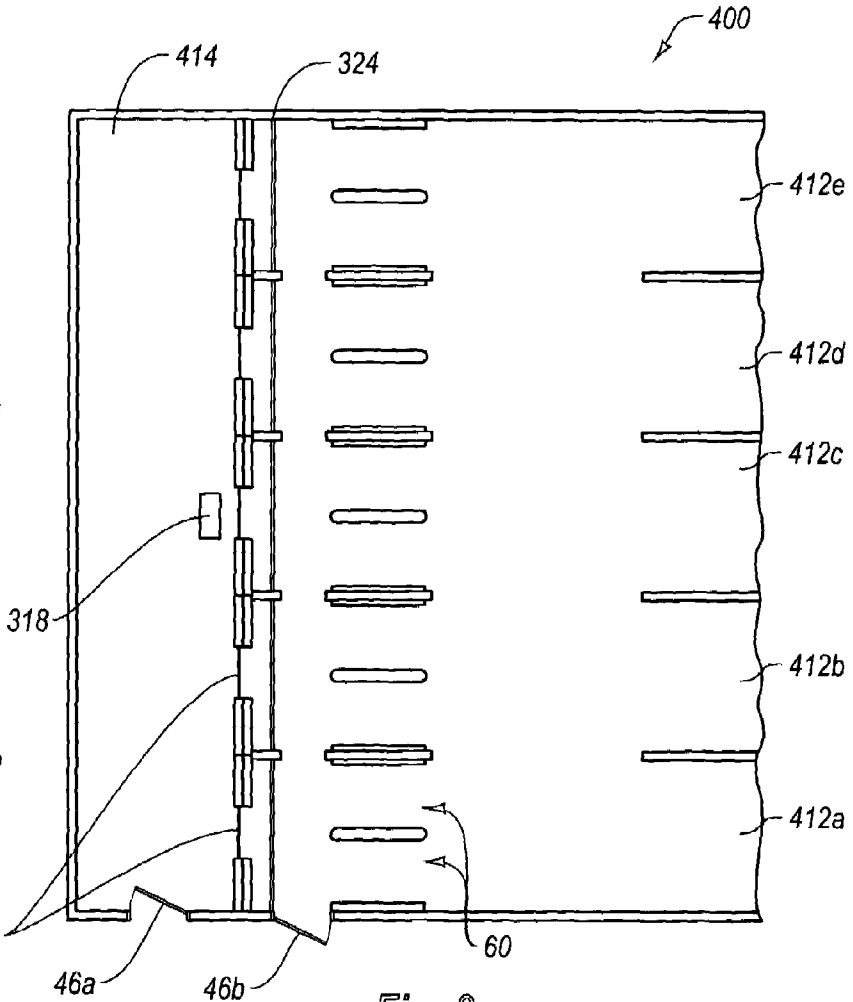
FIG. 9 illustrates a cross-sectional top view of still another system according to the present invention.
Figure 8:
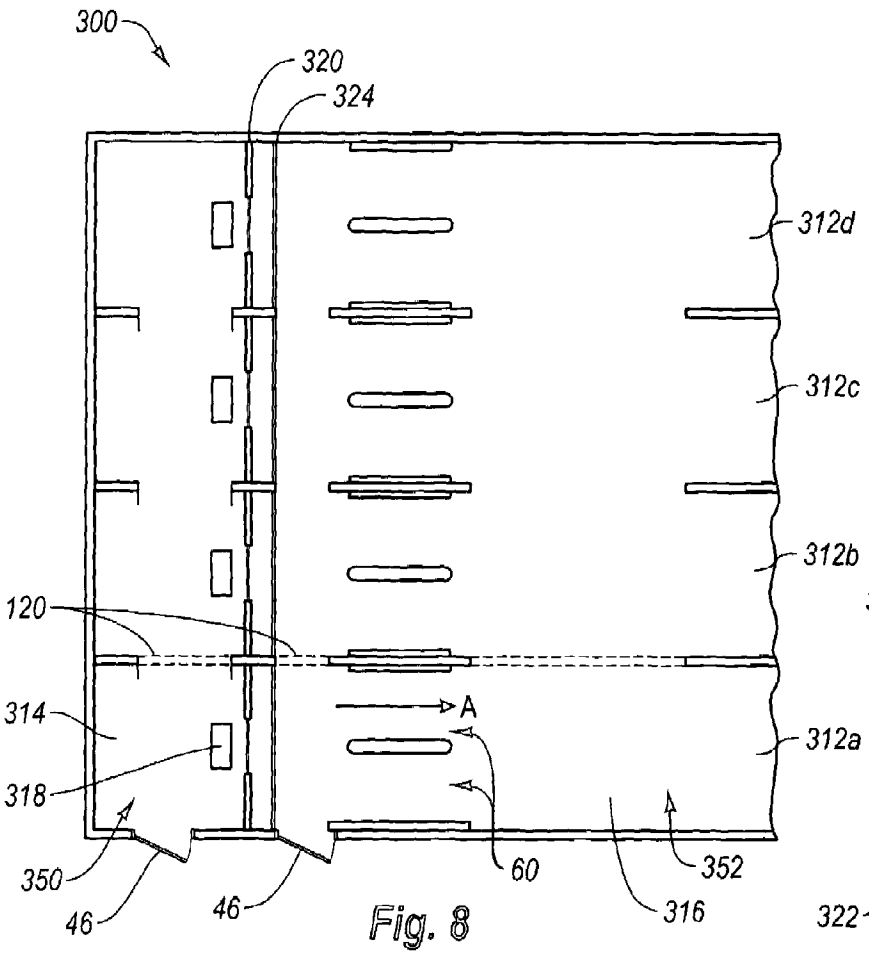
FIG. 8 illustrates a cross-sectional top view of another system according to the present invention.

Turning to FIGS. 8 and 9, illustrated are additional configurations of shooting range systems 300 and 400 of the present invention. One or more shooting range modules 312 can be mounted together in a similar manner to that illustrated in FIG. 1, thereby providing flexibility to indoor training and testing, such as described above. Although four shooting range modules 312*a-d* are illustrated, it will be appreciated that the shooting range system 300 can include less than four or more than four shooting range modules. It can also be understood that the functions and features of the systems illustrated in FIGS. 8 and 9 can apply to the systems described in FIGS. 1-7, or vice versa.

The following discussion will be generally be directed to the first shooting range module 312*a* of the shooting range system 300; however a similar discussion may be made for the other shooting range modules 312*b-d*. In FIG. 8, the shooting range module 312*a* can include a control booth 314. In one implementation, the control booth 314 is integrally formed with shooting range modules 312*a-d*. For example, in the illustrated implementation, a first portion 350 of a shooting range module 312*a* can be pre-engineered with a control booth 314. Firing positions 60 can be located in the second portion 352, which defines at least a portion of the shooting area 316. In this manner, control booth 314 can be used to control components of shooting range module 312*a* and/or monitor a person or targets within the shooting area 316.

As described above with respect to shooting range system 10 (FIG. 1), the first portion 350 can be engineered with one or more removable panels 120, one being illustrated with dotted lines. Once the removable panel 120 is removed, the resultant opening may be left open to allow unimpeded access to the first portion 350 of the adjacently positioned shooting range modules 312*b-d*. Stated another way, upon removal of removable panel 120, access is provided to the control booth of any adjacent shooting range modules 312*b-d*. The control booth 314 for shooting range system 300 can then be optionally defined by one or the combination of accessible control booths from the positioned shooting range module 312*b-d*. Accordingly, the first portion 350 may, either alone or in combination with adjacent shooting range modules, define the control booth 314, and is thus expandable to accommodate the various number of shooting lanes.

A module control 318 can be positioned within control booth 314 of shooting range module 312*a*, and can be used to monitor any number of shooting lanes and/or operate various components of shooting range system 300. The module control 318 can be operatively connected to the ventilation system 16 (FIG. 1) to manage operation of the air flow through all or part of shooting range system 300. For instance, the module control 318 can control the ventilation system 16 of shooting range module 312*a*, the ventilation system of control booth 314, and/or any or all of the ventilation systems of shooting range modules 312*b-d*.

Additionally, the module control 318 can be operatively connected to various other components of the electrical system. For example, the module control 318 may control lighting, communication systems, electronic retrieval systems 72 (FIG. 2), monitors 66 (FIG. 2), etc. of shooting range module 312*a* and/or any and all of the shooting range modules 312*b-d*.

Optionally, one module control 318 can act as a master control to control all shooting range modules 312*a-d* within the shooting range system 300. Further, each module control 318 can be modular and moved from one shooting range module to another to maintain the module control 318, or master control, centrally within the shooting range system 300. Accordingly, each shooting range module 312*a-d* can include electrical and signal transmitting connections to enable movement and repositioning of the control module 318.

In addition to the one or more removable panels 120, the shooting range module 312*a* and any or all of the shooting range modules 312*b-d* can include a divider wall 320 that extends between the control booth 314 and the shooting area 316. The divider wall 320 can allow participants, onlookers, or others to be positioned outside the danger zone and the shooting area 316, while also allowing them to move around and monitor any of the various shooting lanes. In addition, the divider wall 320 creates a separation between the control booth 314 and the shooting area 316 that aids with sound attenuation. When shooting range system 300 includes divider wall 320, one or more doors 46 may also be formed in shooting range modules 312*a* to allow access to the control booth 314 and/or shooting area 316.

One or more sight windows 322 can be formed in divider wall 320. In FIG. 8, shooting range module 312*a* has one sight window 322 within divider wall 320. Sight windows 322 allow a person within the control booth 314 to view the shooting area 316, including any people or targets therein. The combination of divider wall 320 and the sight windows 322 can further allow safe monitoring and/or control of shooting area 316. Optionally, divider wall 320 can be fabricated from bullet-proof, anti-rebound, and/or sound-absorbing materials. For instance, divider wall 320 may be made from a steel plate, or may have one more layers of metal, fiber board, safety wood, or other materials. In some configurations, divider wall 320 can be formed from the same or different materials as dividing wall 64 (FIG. 2), deflector structures 104 (FIG. 3), and/or walls 24, 26, 28, and 30 (FIG. 1). Additionally, sight windows 322 can be fabricated from a substantially transparent, bullet-proof and/or anti-rebound material such as bullet-proof glass. In this manner, control booth 314 can be protected from stray bullets or projectiles which may hit against divider wall 320.

The divider wall 320 can also isolate the control booth 314 from the environment within the shooting area 316. In some configurations, the ventilation system 16 (FIG. 1) provides heating and/or air conditioning to shooting area 316. Where control booth 314 is isolated from shooting area 316, control booth 314 can have a separate ventilation system including heating and/or air conditioning components to reduce the risk that contaminants and airborne particles from shooting area 316 will enter control booth 314.

Optionally, ventilation system 16 (FIG. 1) can provide ventilation to shooting area 316 through use of an air-wall 324. In one configuration, the air-wall 324 can be fabricated from a sheet of material which contains a series of holes or perforations through which air from the inlet duct 36 (FIGS. 1, 3) passes to create a laminar flow in shooting area 316 in the direction of arrow A. The sheet of material can be substantially transparent, thus allowing a person inside the control booth 314 to view the shooting area 316 through the sight windows 322 and the air-wall 324. Representative transparent materials usable in the air-wall 324 can include, but are not limited to, polycarbonate (e.g. Lexan) and polyacrylic (e.g. Lucite).

It can be appreciated by a person having ordinary skill in the art that the air-wall 324 can be separate from the divider wall 320, as shown. In other configurations, the divider wall 320 can be perforated or include a series of holes, thereby optionally eliminating the need for the air wall 324. In addition, in some configurations, the sight windows 322 are not formed in divider wall 320. Further, a transparent air-wall 324 may form substantially the entire divider wall 320 and sight windows 322, such that separate sight windows 322 can be omitted without eliminating the visual view of the shooting lanes from control booth 314. Alternatively, either in place of, or in addition to the sight windows 322, a video surveillance system may be used to monitor shooting range module 312*a*. In such an implementation, the master or module control 318 may include one or more display monitors (not shown) which receive a video feed from one or more cameras (not shown) which monitor the shooting lanes. In still other configurations, an inlet register or grill replaces air-wall 324 to deliver heat and/or air to shooting range module 312*a*.

FIG. 9 illustrates an alternative embodiment of a shooting range system, identified by reference numeral 400, having a control module 414 and one or more shooting range modules 412*a-e*. In one implementation, shooting range modules 412*a-e* are separately formed from control module 414. For example, shooting range modules 412*a-e* may be the same or similar to other shooting range modules described herein and can be mounted together to create the shooting range system 400, thereby providing flexibility to indoor training and testing. Although five shooting range modules 412*a-e* are illustrated in the shooting range system 400, it can be understood by those skilled in the art that the shooting range 400 can include more or fewer than five shooting range modules.

As illustrated, the shooting range system 400 can include the control module 414 which is separate from the shooting range modules 412*a-e*. The control module 414 functions in a similar manner to the control booth of FIG. 8, i.e. by providing a safe location for a range controller to view and control at least one of the lighting, heating, cooling, target retrieval, etc. of the shooting range modules 412*a-e*. As the control module 414 is separate from shooting range modules 412*a-e*, it can be transported separately and may be installed either at the same time as or after the shooting range modules 412*a-e*. In one implementation, the control module 414 is a modular container which is configured to allow a person to control and/or monitor the inside of the shooting range modules 412*a-e*. The length and/or height of the control module 414 can be adapted to form a spatial relationship with shooting range modules 412*a-e*. For example, the control module 414 may be constructed similar to the shooting range module 212 as illustrated in FIG. 5, such that the length, width, and/or height is selectively configurable. Control module 414 can be adapted such that its length is substantially the same as all or a portion of the combined width of shooting range modules 412*a-e*. In this manner, a person in the control module 414 can monitor shooters, targets, and components within shooting range modules 412*a-e* from within a single container, whether or not such module is fabricated from one or more separate modules or containers.

In the illustrated implementation of the shooting range system 400, separate doors 46*a-b* are provided to allow access to the control module 414 and the shooting range modules 412*a-e*, respectively. Door 46*a* is formed on the end of the structure making up the control module 414. In addition, door 46*a* may be single-swing or double-swing, or may be an access door similar to access door 76 (FIG. 2). Door 46*b* may also be any type of door as previously described. In the illustrated implementation, for example, the shooting range modules 412*a-e* include removable panels 120 between air-wall 324 and shooting positions 60. The removable panels can form a walk-way behind the shooting positions 60, and can further be adapted to support the door 46*b*.

Control module 414 can be selectively connected to the shooting range modules 412*a-e*. By connecting the control module 414, a person within the control module 414 can monitor or control the shooting range system 400. For example, the control module 414 can include a master control or one or more module controls 318 which allows control of targets, lighting, air flow, and the like within shooting range modules 412*a-e*. To facilitate such control, the control module 414 can be connected to shooting range modules 412*a-e* in any manner as described above, or by any other suitable method. Corresponding male-type and female-type connections may be positioned on the shooting range modules 412*a-e* and/or control module 414 and may be used with or without gaskets to connect a side of control module 414 to at least one end of the shooting range modules 414*a-e*. In other embodiments, the control module 414 is only electrically connected to the shooting range modules 412*a-e* such as where, for example, a video surveillance system is used to monitor the shooting lanes.

Optionally, the shooting range system 400 may have sight windows 322 positioned between the control module 414 and the shooting range modules 412*a-e*. Sight windows 322 act as means for visually monitoring the shooting lanes, as described above. The sight windows 322 may be fabricated from a transparent bulletproof material or can be one or more removable panels. In one configuration, mating sight windows 322 are installed in the walls of each of the structures forming the shooting range modules 412*a-e* and the control module 414. It can be appreciated, however, that in other configurations, the shooting range modules 412*a-e* and/or the control module 414 may have removable panels in which sight windows 322 can be placed either before or after shooting range modules 412*a-e* are coupled to control module 414. Additionally, in some configurations of shooting range system 400, an air-wall 324 is connected to the ventilation system 16 (FIG. 1), as described above, and provides laminar air flow along the length of shooting range modules 412*a-e*.

Generally, the shooting range system of the present invention is fully capable of modular expansion as shooting range demand increases and is completely self-contained only requiring power source and location from the customer. The shooting range system is also transportable in sections to reassemble at alternative locations, includes means for abating noise to satisfy statutory noise emission specifications, and includes a ventilation system that is designed to ventilate across entire range removing harmful vapors, fumes, and airborne particulate matter safely during range operation.

By achieving the above, the present invention can function as a modular shooting range for Military and Law Enforcement training and test firing use. The modular characteristics of the shooting range system enable a customer to purchase and use module as needed based upon location and budgetary constraints. For instance, a customer may need a total of ten firing positions, but can only afford to purchase two positions. The present invention enables the used to continue to purchase and add shooting modules until their end goal for the number of positions required is met. This important feature allows many ranges of the Military and Law Enforcement to start their training as needed and allow the customer to plan further expansion into their yearly budget, as this is a piece of equipment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A shooting range module comprising:

a first shooting container comprising:

an elongate exterior side wall with at least one removable panel to provide access to a second shooting container positioned adjacent to said first shooting container along said elongate exterior side wall, an area adjacent said at least one removable panel being pre-engineered with one or more structural supports to maintain structural integrity of said first shooting container during transport and assembly of said first shooting container;

at least one shooting lane disposed within an interior of said first shooting container, said at least one shooting lane being disposed generally parallel to said elongate exterior side wall and said at least one removable panel; and a control booth disposed within the interior of said first shooting container and separated from the at least one shooting lane, said control booth having at least one panel which is removable to provide access to a control booth in the second shooting container; and a second shooting container that is connected to the first shooting container in a side-by-side and abutting relationship, the second shooting container comprising:

an elongate exterior side wall with at least one removable panel to provide access to the first shooting container positioned adjacent to said second shooting container along said elongate exterior side wall, an area adjacent said at least one removable panel being pre-engineered with one or more structural supports to maintain structural integrity of said second shooting container during transport and assembly of said second shooting container;

at least one shooting lane disposed within an interior of said second shooting container, said at least one shooting lane being disposed generally parallel to said elongate exterior side wall and said at least one removable panel; and a control booth disposed within the interior of said second shooting container and separated from the at least one shooting lane, said control booth having at least one panel which is removable to provide access to the control booth in the first shooting container.

2. The shooting range module as recited in claim 1, wherein said at least one shooting lane of the first shooting container is in visual view from said control booth of the first shooting container.

3. The shooting range module as recited in claim 2, further comprising one or more sight windows to provide a visual view of said at least one shooting lane of the first shooting container from said control booth of the first shooting container.

4. The shooting range module as recited in claim 1, further comprising a divider wall that divides said control booth from said at least one shooting lane of the first shooting container.

5. The shooting range module as recited in claim 1, further comprising an air-wall connected to a ventilation system adapted to provide laminar flow in a pre-determined direction through at least a portion of said first shooting container.

6. The shooting range module as recited in claim 1, wherein said control booth of the first shooting container has a module control adapted to control at least one of a lighting, heating, cooling, or target retrieval system of said first shooting container.

7. A shooting range system comprising:

at least two shooting range containers disposed adjacent one to another in a side-by-side and abutting relationship, each of said at least two shooting range containers comprising:

a first end and a second end;

at least one elongate exterior wall disposed between said first end and said second end, each of said shooting range containers having an elongate configuration;

at least one firing position disposed within an interior of said shooting range container at a first portion;

means, disposed at a second portion of said interior of said shooting range container, for collecting projectiles fired from said at least one firing position; and at least one removable panel to provide access between said at least two adjacent and abutting shooting range containers, said shooting range containers being configured such that when said at least one removable panel is removed, a walkway is provided between said adjacent and abutting shooting range containers, said walkway being located generally perpendicular to a firing lane disposed between said firing position and said means for collecting projectiles.

8. The shooting range system as recited in claim 7, wherein at least one said at least two shooting range containers further comprises a ventilation system that removes contaminates and airborne particles from and selectively heats and cools air within said interior of at least one of said at least two shooting range modules.

9. The shooting range system as recited in claim 8, wherein said ventilation system filters the air at at least a rate of 2000 cubic feet per minute.

10. The shooting range system as recited in claim 7, wherein said means for collecting projectiles comprises at least one bullet trap.

11. The shooting range system as recited in claim 10, wherein said at least one bullet trap comprises at least one collecting canister to receive the projectile.

12. The shooting range system as recited in claim 10, wherein mounted to said bullet trap is a ventilation system that removes contaminates and airborne particles received by said bullet trap.

13. The shooting range system as recited in claim 7, wherein said interior further comprises at least one deflector structure that deflects the projectiles to said means for collecting projectiles, said at least one deflector structure comprises one or more of a metallic layer, a fiber board layer, a safety wood layer, a sound controlling layer.

14. The shooting range system as recited in claim 7, wherein each of said at least two shooting range containers further comprise a top and a bottom, and wherein said at least one elongate exterior wall includes a first wall and a second wall, at least one of said top, said bottom, said first wall, said second wall, said first end, and said second end comprising a layer of sound controlling material.

15. The shooting range system as recited in claim 7, further comprising a control module operatively connected to said at least two shooting range containers.

16. The shooting range system as recited in claim 15, wherein said control module includes one or more control booths that are distinct and divided from said at least one firing position, and which are built into and integral with said at least two shooting range containers.

17. The shooting range system as recited in claim 15, wherein said control module is a control booth container which is separate from said at least two shooting range containers, and wherein said control booth container is mounted to said first end of said at least two shooting range containers.

18. A modular shooting range comprising:

a first shooting container including a side wall, the first shooting container comprising:

a first portion including a firing position, the side wall forming at least a portion of the first portion;

a second portion including one or more shooting lanes, the side wall forming at least a portion of the second portion;

a third portion including one or more bullet receiving portions, the side wall forming at least a portion of the third portion; and one or more removable panels disposed in the side wall of the first shooting container, the removable panels being sized and configured to allow access into and out of the first shooting container; and a second shooting container including a side wall, the second shooting container comprising:

a first portion including a firing position, the side wall forming at least a portion of the first portion;

a second portion including one or more shooting lanes, the side wall forming at least a portion of the second portion;

a third portion including one or more bullet receiving portions, the side wall forming at least a portion of the third portion; and one or more movable panels disposed in the side wall of the second shooting container, the movable panels being sized and configured to allow access into and out of the second shooting container;

wherein at least a portion of the first shooting container abuts the second shooting container to allow one or more of the movable panels to be moved to allow direct access between the first shooting container and the second shooting container.

19. The modular shooting range as in claim 18, wherein at least one of the movable panels in the first shooting container is directly aligned with at least one of the movable panels in the second shooting container.

20. The modular shooting range as in claim 18, further comprising a control booth connected to the first shooting container and the second shooting container.

21. The modular shooting range as in claim 18, further comprising a door in the first shooting container.

22. The modular shooting range as in claim 18, wherein at least one of the removable panels is located in the second portion of the first shooting container; and wherein at least one of the removable panels is located in the second portion of the second shooting container.

23. The modular shooting range as in claim 18, wherein the first portion of the first shooting container forms a first end of a shooting module;

wherein the second portion of the first shooting container forms an intermediate portion of the shooting module;

wherein the third portion of the first shooting container forms a second end of the shooting module; and wherein the first shooting container may include a plurality of intermediate portions to allow a length of the shooting lanes to be adjusted.

24. The modular shooting range as in claim 18, wherein the first shooting container further comprises:

one or more connecting portions extending outwardly from the first portion of the first shooting container;

one or more receiving portions disposed in the second portion of the first shooting container, the connecting portions of the first portion and the receiving portions of the second portion being sized and configured to connect the first portion and the second portion of the first shooting container;

one or more connecting portions extending outwardly from the second portion of the first shooting container; and one or more receiving portions disposed in the third portion of the first shooting container, the connecting portions of the second portion and the receiving portions of the third portion being sized and configured to connect the second portion and the third portion of the first shooting container.

25. The modular shooting range as in claim 18, wherein the first shooting container further comprises:

one or more overlapping portions extending outwardly from the first portion of the first shooting container, at least a portion of the overlapping portions being disposed within the second portion of the first shooting container; and one or more overlapping portions extending outwardly from the second portion of the first shooting container, at least a portion of the overlapping portions being disposed within the third portion of the shooting container.

26. The modular shooting range as in claim 18, wherein the first shooting container includes a control booth, the side wall of the first shooting container forming at least a portion of the control booth; and wherein the second shooting container includes a control booth, the side wall of the second shooting container forming at least a portion of the control booth.

27. The modular shooting range as in claim 26, further comprising a removable panel disposed in the side wall of the control booth of the first shooting container and the second shooting container;

wherein when the removable panel in the side wall of the control booth of the first shooting container and the removable panel in the side wall of the control booth of the second shooting container are removed, access between the control booth of the first shooting container and the control booth of the second shooting container is provided.

28. The modular shooting range as in claim 18, wherein the first shooting container further comprises a first side wall and a second side wall, the first side wall and the second side wall forming at least a portion of the first portion, the second portion and the third portion of the first shooting container.

29. A modular shooting range comprising:

a first shooting container comprising:

a first portion including a firing position;

a second portion including one or more shooting lanes;

a third portion including one or more bullet receiving portions; and one or more removable panels disposed in the first portion, second portion and/or third portion of the first shooting container, the removable panels being sized and configured to allow access into and out of the first shooting container; and a second shooting container disposed in a side-by-side and abutting relationship with the first shooting container, the second shooting container comprising:

a first portion including a firing position;

a second portion including one or more shooting lanes;

a third portion including one or more bullet receiving portions; and one or more removable panels disposed in the first portion, second portion and/or third portion of the second shooting container, the removable panels being sized and configured to allow access into and out of the second shooting container;

wherein the one or more removable panels allow direct access between the first shooting container and the second shooting container.

30. The modular shooting range as in claim 29, further comprising a control booth connected to the first shooting container, the control booth being adapted to control one or more lighting, heating, cooling, ventilation and/or target retrieval systems of the first shooting container.

31. The modular shooting range as in claim 30, wherein the control booth is adapted to control one or more lighting, heating, cooling, ventilation and/or target retrieval systems of the second shooting container.

32. The modular shooting range as in claim 29, wherein the first shooting container includes a control booth that is adapted to control one or more lighting, heating, cooling, ventilation and/or target retrieval systems of the first shooting container; and wherein the second shooting container includes a control booth that is adapted to control one or more lighting, heating, cooling, ventilation and/or target retrieval systems of the second shooting container.

33. The modular shooting range as in claim 32, further comprising one or more removable panels disposed between the control booth of the first shooting container and the control booth of the second shooting container;

wherein when one or more of the removable panels are removed, direct access between the control booth of the first shooting container and the control booth of the second shooting container is provided.

34. A modular shooting range comprising:

a plurality of substantially independent and self-contained shooting containers, each of the plurality of shooting containers comprising:

a first portion including a firing position;

a second portion including one or more shooting lanes;

a third portion including one or more bullet receiving portions; and one or more removable panels disposed in the first portion, second portion and/or third portion of the shooting containers, the removable panels being sized and configured to allow direct access between adjacent and abutting shooting containers when the removable panels are removed; and a single control module connected to the plurality of shooting containers, the single control module being adapted to control one or more lighting, heating, cooling, ventilation and/or target retrieval systems of each of the plurality of shooting containers.

35. A modular shooting range including a plurality of substantially independent and self-contained shooting containers arranged in a side-by-side and abutting relationship, the modular shooting range comprising:

a first shooting container including one or more shooting lanes and one or more removable panels and a control booth with one or more removable panels a second shooting container including one or more shooting lanes and one or more removable panels and a control booth with one or more removable panels; and wherein the removable panels of the first shooting container and the second shooting container allow direct access between the first shooting container and the second shooting container when one or more of the removable panels are removed and wherein the removable panels of the control booths allow direct access between the control booth of the first shooting container and the control booth of the second shooting container when one or more of the removable panels are removed.

* * * * *

UNITED STATES PATENT AND TRADEMARK OFFICE

CERTIFICATE OF CORRECTION

PATENT NO. : 7,357,394 B2
APPLICATION NO. : 11/189511
DATED : April 15, 2008
INVENTOR(S) : Michael D. Halverson It is certified that error appears in the above-identified patent and that said Letters Patent is hereby corrected as shown below:

Column 1
Line 61, change “ranges” to --range--
Line 65, change “difficult. to” to --difficult to--

Column 2
Line 3, change “exits” to --exists--
Line 52, change “a one” to --one--
Line 53, change “shot” to --shoot--
Line 54, change “firearm” to --firearms--

Column 3
Line 50, change “an” to --a--

Column 4
Line 25, after both instances of “range” insert --module--

Column 5
Line 59, change “target” to --targets--

Column 6
Line 11, change “target” to --targets--
Line 41, change “limited, to” to --limited to,--
Line 51, change “an” to --a--
Line 56, change “14” to --104--

Column 7
Line 54, change “tested. 10511” to --tested.--
Line 55, insert new paragraph indent before “To”

Column 8
Line 12, change “accessing” to --access--

Column 9
Line 3, change “reducing in” to --reducing--
Line 9, change “usable” to --may be used--
Line 14, change “or” to --of--

Column 11
Line 63, change "limited, to" to --limited to,--

Column 12
Line 59, remove the second instance of "be"

Column 13
Line 19, change "module" to --modules--

Column 16
Line 28, change "across entire" to --across the entire--
Line 38, change "the used" to --users--

Signed and Sealed this

Second Day of February, 2010

David J. Kappos

David J. Kappos
*Director of the United States Patent and Trademark Office*